US005769970A

United States Patent [19]

Robelet et al.

[11] Patent Number: 5,769,970

[45] Date of Patent: Jun. 23, 1998

[54] STEEL FOR THE MANUFACTURE OF SEPARABLE MECHANICAL COMPONENTS AND SEPARABLE MECHANICAL COMPONENT

[75] Inventors: Marc Robelet, Florange; Jacques Bellus, Scy-Chazelles, both of France

[73] Assignee: Ascometal (Societe Anonyme), Puteaux, France

[21] Appl. No.: 767,430

[22] Filed: Dec. 16, 1996

[30] Foreign Application Priority Data

Dec. 14, 1995 [FR] France ..... 95 14833

[51] Int. Cl.[6] ..... C22C 38/02; C22C 38/60

[52] U.S. Cl. ..... 148/320; 420/87

[58] Field of Search ..... 420/87; 148/320

[56] References Cited

U.S. PATENT DOCUMENTS

| | | | |
|---|---|---|---|
| 2,182,758 | 12/1939 | Harder | 420/84 |
| 2,182,759 | 12/1939 | Harder | 420/84 |
| 2,402,862 | 6/1946 | Wright | 420/87 |
| 4,168,159 | 9/1979 | Schlatter et al. | 420/87 |
| 4,786,466 | 11/1988 | Holowaty | 420/84 |
| 5,055,253 | 10/1991 | Nelson | 420/87 |
| 5,135,587 | 8/1992 | Olaniran et al. | 148/320 |

*Primary Examiner*—Deborah Yee

*Attorney, Agent, or Firm*—Oblon, Spivak, McClelland, Maier & Neustadt, P.C.

[57] ABSTRACT

Steel useful for the manufacture of a separable mechanical component, whose chemical composition preferably comprises, by weight: $0.25\% \leqq C \leqq 0.75\%$, $0.2\% \leqq Si \leqq 1.5\%$, $0.1\% \leqq Mn \leqq 2\%$, $0\% \leqq Ni \leqq 1\%$, $0\% \leqq Cr \leqq 1\%$, $0\% \leqq Mo \leqq 1\%$, $0\% \leqq Cu \leqq 1\%$, $0\% \leqq V \leqq 0.2\%$, $0.02\% \leqq S \leqq 0.35\%$, $0.04\% \leqq P \leqq 0.2\%$, $0\% \leqq Al \leqq 0.005\%$, $0.005\% \leqq N \leqq 0.02\%$; optionally at least one element taken from lead, tellurium and selenium in contents of less than 0.1%, the balance being iron and impurities resulting from the smelting, the steel being optionally treated with calcium. Use of the steel for the manufacture of a separable component and component obtained.

32 Claims, No Drawings

STEEL FOR THE MANUFACTURE OF SEPARABLE MECHANICAL COMPONENTS AND SEPARABLE MECHANICAL COMPONENT

BACKGROUND OF THE INVENTION

1. Field of the Invention

The present invention relates to a steel which is particularly useful in the manufacture of a separable mechanical component, especially for the manufacture of a connecting rod for an internal-combustion engine. Components comprising the invention steel also make up part of the invention. Connecting rods made of forged invention steel are highly preferred. The manufacture of components using the invention steel is also a part of the invention.

2. Discussion of the Background

Some mechanical components such as, for example, internal-combustion engine connecting rods, consist of at least two separable elements joined together by fixing means, such as bolts. These components may be made of cast iron, of sintered and forged metal powder, or of forged steel.

The steel of which forged-steel connecting rods are composed must be forgeable, easily machinable and exhibit mechanical properties ensuring good in-service behaviour of the connecting rods. The mechanical properties generally required are a hardness of between 210 HB and 360 HB and a tensile strength of between 650 MPa and 1200 MPa, in order to obtain sufficient fatigue behaviour, and a yield stress of between 300 MPa and 800 MPa so as to avoid strains above the yield point.

The precise choice of the properties required for a particular connecting rod intended for a particular engine depend on the design of the connecting rod and on the nature of the engine into which it is incorporated. The steel of which it is composed is chosen as a function of these mechanical properties and, often, of the manufacturing process which comprises, after the forging operation, a controlled cooling step intended to obtain a ferritic-pearlitic structure which possesses the required mechanical properties and satisfactory machinability. The steels used are generally carbon steels of the XC42 type or low-alloy steels of the 45M5, 30MSV6, 38MVS5 (as per the French Standard) type. The carbon content is mainly chosen as a function of the required hardness level, and the alloy elements are added either in order to increase the hardenability of the steel, so as to increase the proportion of pearlite, which promotes machinability, or in order to harden the ferrite and improve the yield stress/tensile strength ratio. With these steels, the various parts of the connecting rod can only be separated by machining, which requires a complex and expensive range of machining operations.

Some cast-iron connecting rods or connecting rods obtained by powder metallurgy may be separated into two elements by an operation of brittle fracture in a predetermined plane. This so-called separable-component technique has several advantages, and especially that of considerably simplifying the manufacturing scheme by eliminating machining operations; however, it does have drawbacks resulting from the nature of the materials which can be used.

In order to profit from the advantages of the separable connection rod technique when applied to steel connecting rods, it has been proposed, in U.S. Pat. 5,135,587, to use a steel whose chemical composition comprises, by weight: from 0.6% to 0.75% of carbon, from 0.2% to 0.5% of manganese, from 0.04% to 0.12% of sulfur with Mn/S>3, the balance being iron and impurities, the impurities content being less than 1.2%, the structure being virtually 100% pearlitic and the grain size being between 3 and 8 ASTM. The impurities, taken from P, Si, Ni, V, Cu, Cr and Mo, preferably have individual contents such that: $Ni \leqq 0.2\%$, $Mo \leqq 0.02\%$, $Cr \leqq 0.1\%$, $Cu \leqq 0.15\%$, $V \leqq 0.035\%$, $0.15\% \leqq Si \leqq 0.35\%$ and $P \leqq 0.035\%$. However, this steel, which is of the XC70 (as per the French Standard) type, has the drawback of exhibiting irregular behaviour during the brittle fracture operation, especially because it is virtually impossible under industrial conditions to control the proportion of the proeutectoid phase, this possibly varying from 0% to 15% depending on the precise chemical composition of the steel and on the manufacturing means used, which renders it difficult to be used industrially; in addition, it only allows the properties specific to XC70 to be obtained, thereby limiting its use to components for which these properties are suitable.

OBJECTS OF THE INVENTION

One object of the present invention is to remedy these drawbacks by providing a steel which makes it possible to obtain the mechanical properties required for a wide range of applications, especially in the field of connecting rods, and good machinability, while still allowing the brittle fracture operation to be carried out under satisfactory industrial conditions.

To this end, one subject of the invention is a steel for the manufacture of a separable mechanical component, whose chemical composition comprises, by weight: $0.25\% \leqq C \leqq 0.75\%$, $0.2\% \leqq Si \leqq 1.5\%$, $0.1\% \leqq Mn \leqq 2\%$, $0\% \leqq Ni \leqq 1\%$, $0\% \leqq Cr \leqq 1\%$, $0\% \leqq Mo \leqq 1\%$, $0\% \leqq Cu \leqq 1\%$, $0\% \leqq V \leqq 0.2\%$, $0.02\% \leqq S \leqq 0.35\%$, $0.04\% \leqq P \leqq 0.2\%$, $0\% \leqq Al \leqq 0.005\%$, $0.005\% \leqq N \leqq 0.02\%$; optionally at least one element taken from lead, tellurium and selenium each in contents of less than 0.1%, the balance being iron and impurities resulting from smelting, the steel being optionally treated with calcium.

Preferably, the chemical composition of the invention steel satisfies at least one of the following relationships: $0.06\% \leqq P \leqq 0.12\%$, $0.8\% \leqq Si \leqq 1.2\%$, $0.05\% \leqq V \leqq 0.15\%$.

The chemical composition of the steel may be such that: $0.65\% \leqq C \leqq 0.75\%$, $0.2\% \leqq Si$, $0.25\% \leqq Mn \leqq 1\%$, $Ni \leqq 0.15\%$, $Cr \leqq 0.15\%$, $Mo \leqq 0.05\%$, $Cu \leqq 0.35\%$.

The chemical composition of the steel may also be such that: $0.25\% \leqq C \leqq 0.5\%$, $0.2\% \leqq Si$, $Ni \leqq 0.15\%$, $Cr \leqq 0.15\%$, $Mo \leqq 0.05\%$ and $Cu \leqq 0.35\%$, with, preferably $0.25\% \leqq Mn \leqq 1.3\%$.

The invention also relates to the use of the steel according to the invention for the manufacture of mechanical components, generally comprising at least two elements, obtained by brittle fracture of a blank for the said component, as well as to the said component. This component may possibly be, especially, a connecting rod for an internal-combustion engine made, for example, of an invention steel having a hardness of between 210 HB and 360 HB, a tensile strength of between 650 MPa and 1200 MPa, most of the grains being relatively coarse, the ASTM size index of the austenitic grains of which is less than 5, and preferably having a structure consisting of at least 70% pearlite.

DESCRIPTION OF THE PREFERRED EMBODIMENTS

The steel according to the invention is a carbon or low-alloy structural steel, the chemical composition of which comprises, by weight based on total weight:

more than 0.25% of carbon, in order to enable a ferritic-pearlitic or pearlitic structure of hardness greater than 210 HB to be obtained, but less than 0.75% so as to avoid the formation of iron carbides which are unfavorable to machinability (0.3, 0.4, 0.5, 0.6 and 0.7% carbon are included as are all ranges between all carbon values);

from 0.04% to 0.2%, and preferably from 0.06% to 0.12%, including 0.1, 0.15 and 0.18 and all ranges between all values, of phosphorus so as to embrittle the structure, and in particular the ferrite, obtained after forging and heat treatment; when the structure is, especially, essentially pearlitic, this phosphorus content makes it possible to achieve good reproducibility of the brittle fracture of mechanical-component blanks; preferably, the phosphorus content is such that: $P \geqq 0.18-0.2 \times C$. A toughness $K_{cv}$ of less than approximately 7 joules at room temperature is preferred, this providing good 100%-brittle fracturability with a lateral deformation not exceeding 120 $\mu$m;

less than 0.005%, and preferably less than 0.003%, of aluminum so as to avoid the presence of alumina inclusions unfavorable to machinability and also in order to avoid forming aluminum nitrides which prevent grain coarsening during the reheating before forging, this being unfavorable to brittle fracturability;

from 0.2% to 1.5% of silicon, including 0.3, 0.4, 0.5, 0.6, 0.7, 0.8, 0.9, 1.0, 1.1, 1.2, 1.3 and 1.4 and all ranges between all silicon values; silicon is a deoxidizing element which must be added in contents greater than 0.2% in order to ensure good deoxidation; however, at higher contents, this element hardens and embrittles the ferrite, which is favorable to good machinability; in order to obtain this favorable effect, its content may preferably be fixed between 0.8% and 1.2%;

from 0% to 0.2%, and preferably from 0.05% to 0.15% (including 0.07, 0.1 and 0.12% and all ranges between all values), of vanadium in order to harden the ferrite and improve the yield stress/tensile strength ratio;

from 0.02% to 0.35%, and preferably from 0.05% to 0.12%, including 0.08, 0.10 and 0.11 as well as 0.15, 0.2, 0.25 and 0.3% and all ranges between all values, of sulfur in order to improve the machinability;

optionally, at least one element taken from lead, tellurium and selenium each present in contents of less than 0.1% so as to improve the machinability;

from 0.1% to 2%, and preferably more than 0.25% including 0.3, 0.4, 0.5, 0.6, 0.7, 0.8, 0.9, 1%, 1.2% 1.4%, 1.6%, and 1.8% and all ranges between all values, of manganese so as to fix the sulfur in the form of manganese sulfides, and in this case the sulfur content may preferably be limited to 1%; however, manganese may also be added in order to increase the hardenability so as to lower the ferritic-pearlitic transformation start. temperature and thus to limit the ferrite content, which is favorable to machinability;

optionally, one or more elements taken from nickel, chromium, molybdenum and copper, each in contents of between 0% and 1% so as to adjust the hardenability; when these elements are not intentionally added, they may, nevertheless, exist by way of residual elements provided by the raw materials during smelting; in this case, the nickel and chromium contents are preferably less than 0.15%, the molybdenum content is preferably less than 0.05% and the copper content is preferably less than 0.35%.

From this group of steels may be chosen, depending on the use in question, for example, a close-to-eutectoid steel comprising from 0.65% to 0.75% of carbon, less than 1% of silicon, from 0.25% to 1% of manganese, less than 0.15% of nickel, less than 0.15% of chromium, less than 0.05% of molybdenum, less than, 0.35% of copper and less than 0.005% of aluminum.

It is also possible to use a steel having a lower carbon content, the chemical composition of which comprises, especially, $0.25\% \leqq C \leqq 0.5\%$, $Ni \leqq 0.15\%$, $Cr \leqq 0.15\%$, $Mo \leqq 0.05\%$ and $Cu \leqq 0.35\%$. This steel may be a carbon steel, in which case it contains less than 0.5% of manganese. However, it may also be a low-alloy steel containing manganese, silicon or optionally vanadium. It may then contain between 1% and 2% of manganese and/or between 0.5% and 1.5% of silicon and/or between 0.5% and 0.2% of vanadium.

All steels of the invention may optionally be treated with calcium. Preferably, this calcium treatment comprises adding calcium to liquid steel before casting.

In order to manufacture a separable component, a billet of steel according to the invention is taken and heated at a temperature of between 1100° C. and 1300° C. so as, on the one hand, to austenitize it, on the other hand to cause grain coarsening and, finally, to give it the ductility necessary for forging; it is then forged in order to give it the desired shape, the forging operation terminating at a temperature greater than 850° C. Directly after forging, it is cooled in a controlled manner down to room temperature, for example in a cooling tunnel, at an average cooling rate between the end-of-forging temperature and 200° C. being between 0.5° C./s and 15° C./s, including 1, 3, 5, 7, 9, 10, 12 and 14° C./s. By proceeding in this way, a ferrito-pearlitic structure is obtained with most of the grains being relatively coarse, the ASTM size index of the austenitic grains being less than 5, containing less than 30% of ferrite and having the required hardness and tensile properties and a toughness of less than 7 joules at room temperature. The component blank thus obtained is then machined and then split into two elements by impact-induced brittle fracture.

EXAMPLES

By way of a first example, connecting rods were manufactured using a steel of the XC70 type, the chemical composition of which comprised, by weight based on total weight:

C=0.71%
Si=0.25%
Mn=0.8%
Ni=0.08%
Cr=0.05%
Mo=0.01%
Cu=0.3%
S=0.07%
P=0.045%
Al=0.002%
N=0.012%, the balance being iron and impurities resulting from smelting.

Before forging, the steel billets were heated to 1250° C., the end-of-forging temperature being 1000° C. After forging, the blank was cooled by passing it through a controlled-cooling tunnel at average cooling rates of between 1° C./s and 3° C./s so as to simulate the effect of scatter intrinsic in manufacture on an industrial scale. The properties obtained were:

structure: pearlitic with 0% to 15% of ferrite;

HB of between 270 and 310;

$R_m$ of between 900 MPa and 1050 MPa;

$R_e$ of between 500 MPa and 600 MPa;

$K_{cv}$ of less than 7 joules at room temperature.

The blanks were then machined and then all separated into two elements by brittle fracture. Thigh brittle-fracture separation was accomplished without any difficulties, whatever the ferrite content.

By way of a second example, connecting rods were manufactured using a steel of the 50M5 type, the chemical composition of which comprised, by weight:

C=0.505%

Si=0.240%

Mn=1.3%

Ni=0.11%

Cr=0.08%

Mo=0.01%

Cu=0.32%

S=0.085%

P=0.075%

Al=0.003%

N=0.011%, the balance being iron and impurities resulting from smelting.

Before forging, the steel billet was heated to 1250° C., the end-of-forging temperature being 1000° C. After forging, the blank was cooled by passing it through a controlled-cooling tunnel at average cooling rates of between 1° C./s and 6° C./s so as to simulate the effect of scatter intrinsic in manufacture on an industrial scale. The properties obtained were:

structure: pearlitic with 0% to 20% of ferrite;

HB of between 260 and 300;

$R_m$ of between 860 MPa and 1000 MPa;

$R_e$ of between 400 MPa and 650 MPa;

$K_{cv}$ of less than 6 joules at room temperature.

The blanks were then machined and then all separated into two elements by brittle fracture. This brittle fracture separation was accomplished without any difficulties, whatever the ferrite content.

By way of a third example, connecting rods were manufactured using a steel of the 38MSV5 type, the chemical composition of which comprised, by weight:

C=0.39%

Si=0.75%

Mn=1.24%

Ni=0.13%

Cr=0.15%

Mo=0.005%

Cu=0.2%

V=0.105%

S=0.11%

P=0.103%

Al=0.004%

N=0.009%, the balance being iron and impurities resulting from smelting.

Before forging, the steel billet was heated to 1260° C., the end-of-forging temperature being 1030° C. After forging, the blank was cooled by passing it through a controlled-cooling tunnel at average cooling rates of between 1° C./s and 6° C./s so as to simulate the effect of scatter intrinsic in manufacture on an industrial scale. The properties obtained were:

structure: pearlitic with 0% to 25% of ferrite;

HB of between 260 and 310;

$R_m$ of between 880 MPa and 1050 MPa;

$R_e$ of between 500 MPa and 700 MPa;

$K_{cv}$ of less than 6.5 joules.

The blanks were then machined and then all separated into two elements by brittle fracture. This brittle fracture separation was accomplished without any difficulties, whatever the ferrite content.

These examples show that with the steels according to the invention it is possible to manufacture, in a reliable manner, separable connecting rods and, more generally, separable components having structures of the ferrito-pearlitic type, which are easy to machine at high and low cutting speeds.

This application is based on French Patent Application 95 14 833 filed Dec. 14, 1995, incorporated herein by reference.

What is claimed as new and desired to be secured by Letters Patent of the United States is:

1. Steel which comprises, by weight based on total weight:

$0.25\% \leqq C \leqq 0.15\%$ $0.2\% \leqq Si \leqq 1.5\%$ $0.1\% \leqq Mn \leqq 2\%$ $0\% \leqq Ni \leqq 1\%$ $0\% \leqq Cr \leqq 1\%$ $0\% \leqq Mo \leqq 1\%$ $0\% \leqq Cu \leqq 1\%$ $0\% \leqq V \leqq 0.2\%$ $0.02\% \leqq S \leqq 0.35\%$ $0.04\% \leqq P \leqq 0.2\%$ $0\% \leqq Al \leqq 0.005\%$ $0.005\% \leqq N \leqq 0.02\%$ optionally at least one element selected from the group consisting of lead, tellurium and selenium each in contents of less than 0.1%, the balance being iron and impurities resulting from smelting, the steel optionally having been treated with calcium, wherein the steel has a ferritic-pearlitic structure.

2. The steel as claimed in claim 1, whose chemical composition is such that:

$$0.06\% \leqq P \leqq 0.12\%.$$

3. The steel as claimed in claim 1, whose chemical composition is such that:

$$0.8\% \leqq Si \leqq 1.2\%.$$

4. The steel as claimed in claim 1, whose chemical composition is such that:

$$0.05\% \leqq V \leqq 0.15\%.$$

5. The steel as claimed in claim 1, whose chemical composition is such that:

$0.65\% \leqq C \leqq 0.75\%$ $0.25\% \leqq Mn \leqq 1\%$ $Ni \leqq 0.15\%$ $Cr \leqq 0.15\%$ $Mo \leqq 0.05\%$ Cu≦0.35%

Al≦0.005%.

6. The steel as claimed in claim 1, whose chemical composition is such that:

0.25%≦C≦0.5%

Ni≦0.15%

Cr≦0.15%

Mo≦0.05%

Cu≦0.35%.

7. The steel as claimed in claim 6, whose chemical composition is such that:

0.25%≦Mn≦1%.

8. The steel as claimed in claim 1, which steel is in the shape of a mechanical component, said component comprising at least two elements and being obtained by brittle fracture of a blank.

9. A mechanical component, comprising at least two elements, obtained by brittle fracture of a blank, which component comprises the steel as claimed in claim 1.

10. The component of claim 9, wherein said component is a connecting rod for an internal combustion engine.

11. Steel which comprises, by weight based on total weight:

0.25%≦C≦0.75%

0.2%≦Si≦1.5%

0.1%≦2%

0%≦Ni≦1%

0%≦Cr≦1%

0%≦Mo≦1%

0%≦Cu≦1%

0%≦V≦0.2%

0.02%≦S≦0.35%

0.04%≦P≦0.2%

0%≦Al≦0.005%

0.005%≦N≦0.02% optionally at least one element selected from the group consisting of lead, tellurium and selenium each in contents of less than 0.1%, the balance being iron and impurities resulting from smelting, the steel optionally having been treated with calcium, wherein the steel has a hardness of between 210 HB and 360 HB and a tensile strength of between 650 MPa and 1200 MPa, a majority of grains therein having an austenitic grain ASTM size index of less than 5.

12. The steel as claimed in claim 11, whose chemical composition is such that:

0.06%≦P≦0.12%.

13. The steel as claimed in claim 11, whose chemical composition is such that:

0.8%≦Si≦1.2%.

14. The steel as claimed in claim 11, whose chemical composition is such that:

0.05%≦V≦0.15%.

15. The steel as claimed in claim 11, whose chemical composition is such that:

0.65%≦C≦0.75%

0.25%≦Mn≦1%

Ni≦0.15%

Cr≦0.15%

Mo≦0.05%

Cu≦0.35%

Al≦0.005%.

16. The steel as claimed in claim 11, whose chemical composition is such that:

0.25%≦C≦0.5%

Ni≦0.15%

Cr≦0.15%

Mo≦0.05%

Cu≦0.35%.

17. The steel as claimed in claim 16, whose chemical composition is such that:

0.25%≦Mn≦1%.

18. The steel as claimed in claim 11, which steel is in the shape of a mechanical component, said component comprising at least two elements and being obtained by brittle fracture of a blank.

19. The steel as claimed in claim 18, wherein the component has a ferritic-pearlitic structure.

20. A mechanical component, comprising at least two elements, obtained by brittle fracture of a blank, which component comprises the steel as claimed in claim 11.

21. The component of claim 20, wherein said component is a connecting rod for an internal combustion engine.

22. Steel which comprises, by weight based on total weight:

0.25%≦C≦0.75%

0.2%≦Si≦1.5%

0.1%≦Mn≦2%

0%≦Ni≦1%

0%≦Cr≦1%

0%≦Mo≦1%

0%≦Cu≦1%

0%≦V≦0.2%

0.02%≦S≦0.35%

0.04%≦P≦0.2%

0%≦Al≦0.005%

0.005%≦N≦0.02% optionally at least one element selected from the group consisting of lead, tellurium and selenium each in contents of less than 0.1%, the balance being iron and impurities resulting from smelting, the steel optionally having been treated with calcium, wherein the steel has a structure consisting of at least 70% pearlite.

23. The steel as claimed in claim 22, whose chemical composition is such that:

0.06%≦P≦0.12%.

24. The steel as claimed in claim 22, whose chemical composition is such that:

0.8%≦Si≦1.2%.

25. The steel as claimed in claim 22, whose chemical composition is such that:

0.05%≦V≦0.5%.

26. The steel as claimed in claim 22, whose chemical composition is such that:

$0.65\% \leqq C \leqq 0.75\%$ $0.25\% \leqq Mn \leqq 1\%$ $Ni \leqq 0.15\%$ $Cr \leqq 0.15\%$ $Mo \leqq 0.05\%$ $Cu \leqq 0.35\%$ $Al \leqq 0.005\%$.

27. The steel as claimed in claim 22, whose chemical composition is such that:

$0.25\% \leqq C \leqq 0.5\%$ $Ni \leqq 0.15\%$ $Cr \leqq 0.15\%$ $Mo \leqq 0.05\%$ $Cu \leqq 0.35\%$.

28. The steel as claimed in claim 27, whose chemical composition is such that:

$0.25\% \leqq Mn \leqq 1\%$.

29. The steel as claimed in claim 22, which steel is in the shape of a mechanical component, said component comprising at least two elements and being obtained by brittle fracture of a blank.

30. The steel as claimed in claim 29, wherein the component has a ferrito-pearlitic structure.

31. A mechanical component, comprising at least two elements, obtained by brittle fracture of a blank, which component comprises the steel as claimed in claim 22.

32. The component of claim 31, wherein said component is a connecting rod for an internal combustion engine.

* * * * *

UNITED STATES PATENT AND TRADEMARK OFFICE

CERTIFICATE OF CORRECTION

PATENT NO. : 5,769,970

DATED : June 23, 1998

INVENTOR(S) : Marc ROBELET, et al.

It is certified that error appears in the above-identified patent and that said Letters Patent is hereby corrected as shown below:

On the title page, Item [73], the Assignee, is incorrect. It should read:

-- Ascometal (Societe Anonyme) - Immeuble "La Pacific" --

Signed and Sealed this

Nineteenth Day of January, 1999

*Attest:*

*Attesting Officer*

*Acting Commissioner of Patents and Trademarks*